US005109139A

United States Patent [19]

Dickson et al.

[11] Patent Number: 5,109,139

[45] Date of Patent: Apr. 28, 1992

[54] PROCESS CONTROL OF PROCESS FOR PURIFICATION OF LINEAR PARAFFINS

[75] Inventors: Charles T. Dickson, Houston; Janet R. Fitzke, LaPorte; Christopher L. Becker, Seabrook, all of Tex.

[73] Assignee: Exxon Chemical Patents Inc., Linden, N.J.

[21] Appl. No.: 601,452

[22] Filed: Oct. 23, 1990

Related U.S. Application Data

[63] Continuation-in-part of Ser. No. 238,854, Aug. 31, 1988.

[51] Int. Cl.[5] ..... C07C 7/12

[52] U.S. Cl. ..... 585/821; 208/310 R; 208/310 Z; 585/823; 585/824; 585/826; 585/827

[58] Field of Search ..... 208/310 R, 310 Z; 585/821, 823, 824, 826, 827

[56] References Cited

U.S. PATENT DOCUMENTS

| | | | |
|---|---|---|---|
| 2,881,862 | 4/1959 | Fleck et al. | 585/827 |
| 2,950,336 | 8/1960 | Kimberlin, Jr. et al. | 585/827 |
| 2,978,407 | 4/1961 | Tuttle et al. | 585/827 |
| 3,063,934 | 11/1962 | Epperly et al. | 585/406 |
| 3,182,014 | 5/1965 | Seelig et al. | 585/823 |
| 3,228,995 | 1/1966 | Epperly et al. | 260/676 |
| 3,278,422 | 10/1966 | Epperly et al. | 585/827 |
| 3,393,149 | 7/1968 | Conley et al. | 210/42 |
| 3,558,732 | 1/1971 | Neuzil et al. | 260/674 |
| 4,313,014 | 1/1982 | Kondo et al; | 585/827 |
| 4,337,156 | 6/1982 | Derosset | 208/3102 |
| 4,567,312 | 1/1986 | Miller et al. | 585/419 |
| 4,567,315 | 1/1986 | Owaysi et al. | 585/827 |
| 4,571,441 | 2/1986 | Miwa et al. | 585/820 |
| 4,795,545 | 1/1989 | Schmidt | 208/310 Z |

FOREIGN PATENT DOCUMENTS

| | | |
|---|---|---|
| 0164905 | 12/1985 | European Pat. Off. . |
| 2095861 | 1/1972 | France . |
| 1298202 | 3/1987 | U.S.S.R. . |
| 827433 | 2/1960 | United Kingdom . |

*Primary Examiner*—Curtis R. Davis
*Assistant Examiner*—William C. Diemler
*Attorney, Agent, or Firm*—Linda K. Russell

[57] ABSTRACT

A process for purifying linear paraffins in which a hydrocarbon stream containing linear paraffins contaminated with aromatics, sulfur-, nitrogen-, and oxygen-containing compounds, and color bodies, but essentially free of olefins, is contacted with a solid absorbent such as a NaX zeolite or zeolite MgY. After adsorption the adsorbent is desorbed with an alkyl- substituted aromatic desorbent, such as tuluene. The initial effluent from the adsorb cycle, which will contain a high concentration of residual desorbent, is recycled to a desorbent recovery system. The level of desorbent in the adsorber effluent is monitored on a real time basis until the desorbent level of the adsorber effluent declines from a plateau level, i.e., a 100% plateau level, that correlates with the level of impurities, particularly the aromatic impurities in the feed, which is an indication of aromatics breakthrough, thereby signaling the need to switch the adsorbent beds.

13 Claims, 2 Drawing Sheets

FEED
1
FEED TANK
2
FEED DRUM
4
11
(DESORB. SWEEP)
9
TOLUENE RECOVERY TOWER TANK
10
SFC IMPURITY ANALYZER
SET CYCLE TIME
5a
5b
13
SET CYCLE TIME
ON-LINE TOLUENE ANALYZER
DETECT BREAK-THROUGH
12
PRODUCT TANK
7
6
DESORBENT TANK
8

PROCESS CONTROL OF PROCESS FOR PURIFICATION OF LINEAR PARAFFINS

RELATED APPLICATION

This application is a continuation-in-part application of commonly owned, co-pending patent application U.S. Ser. No. 07/238,854 filed Aug. 31, 1988 entitled "Process for Purification of Linear Paraffins, the disclosure of which in its entirety is hereby incorporated herein by reference thereto.

FIELD OF THE INVENTION

The present invention relates to a process for purifying paraffins, and more specifically is relates to processes for purifying linear paraffin using adsorption. In particular, the present invention is directed to a novel control process to improve the efficiency of the process for purification of linear paraffins which involves monitoring the level of desorbent in the adsorbent effluent.

DESCRIPTION OF BACKGROUND AND RELEVANT MATERIALS

As within any hydrocarbon product whose starting point is crude oil, the degree of purity to which paraffins may be refined covers a wide range from relatively crude to relatively pure. Although each grade of paraffins has commercial use, there are special applications which require a paraffin product of exceptional purity. Certain of these special applications additionally require a paraffin product whose composition is substantially limited to linear paraffins, which may alternatively be referred to as normal, unbranched, or straight-chain paraffins. For example, the manufacture of detergents, in which linear paraffins may serve as the alkyl constituent of sulfonated alkylaryl-and alkyl-sulfonate synthetic detergents. Linear paraffins are preferred in such manufacture because they result in a product having superior detergent properties, which moreover has superior biogradability compared to synthetic detergents manufactured from branched paraffins. Other uses for substantially pure linear paraffins include as ingredients for the manufacture of flameproofing agents; as reaction diluents; as solvents; as intermediates in aromatization reactions; as plasticizers; and for use in protein/vitamin concentrates.

Substantially pure linear paraffins, however, are extremely difficult to obtain linear paraffins intended for industrial and commercial usage are not produced by synthesis, but are instead isolated from naturally-occurring hydrocarbon sources, and most typically from the kerosene boiling range fraction of natural hydrocarbon feedstocks (as used herein, the term "kerosene range" refers to a boiling point range of between about 182°-277° C.) These feedstocks are made up of a wide variety of hydrocarbon constituents and include, in addition to paraffins, contaminants such as aromatic compounds, and heteroatom compounds such as sulfur-containing compounds, nitrogen-containing compounds, and oxygen-containing compounds (i.e., phenolics). The commercial processes used for separating out the linear paraffin component of such feedstocks are generally not sufficiently precise to yield a substantially pure linear paraffin product. Instead, the separated kerosene range linear paraffin product may contain the contaminants described above in amounts sufficient to preclude use of the product for the special applications referred to earlier.

The principal prior art methods for upgrading kerosene range linear paraffins to substantially pure linear paraffins are mild hydrofining followed by acid treating, and severe hydrofining. While acid treating does remove aromatics from kerosene range linear paraffins, this is not an entirely satisfactory procedure. Acid treating addresses only the aromatics component of a contaminated paraffin stream, without improving product purity with respect to heteroatom compounds. In addition, acid treating raises significant concerns relating to health, safety, industrial hygiene, and environmental quality. Moreover, acid treating can actually increase the levels of sulfur in the final product.

As a general matter, processes are known whereby specific hydrocarbon fractions may be purified and/or isolated from a relatively crude source using solid adsorbents. In these prior art processes a bed of a solid adsorbent material is contacted with a hydrocarbon stream in either liquid or a vapor phase under conditions favorable to adsorption. During this contacting stage a minor portion of the hydrocarbon stream is adsorbed into pores in the solid adsorbent, while the major portion, which may be termed the effluent or raffinate, passes through. Depending on the process and the product involved, the adsorbent may be used either to adsorb the desired product, which is then desorbed and recovered, or to adsorb the undesired contaminants, resulting in an effluent which is the purified product.

In either event, during the contacting stage the solid adsorbent gradually becomes saturated with adsorbed material, which consequently must be periodically desorbed. If the adsorbent contains the undesired contaminants, desorption is necessary in order to free the adsorbent for further removal of contaminants. If the adsorbent contains the desired product, desorption both frees the adsorbent for further separation of the desired product from the hydrocarbon stream, and liberates the desired product from the adsorbent for recovery and, if desired, for further processing. Desorption is generally accomplished by first isolating the bed of adsorbent material from the hydrocarbon stream, and then contacting the adsorbent bed with a stream of a substance which has the effect of displacing the adsorbed material from the solid adsorbent. This substance is referred to as desorbent. Once desorption is completed, the bed of solid adsorbent can again be brought into contact with the hydrocarbon stream.

The efficiency of the adsorption/desorption process is determined by several critical factors, including the precise adsorbent selected; temperature; pressure; flow rate of the hydrocarbon stream; concentrations of feed stream components; and, the desorbent. The prior art in this area demonstrates the complexity, and the high degree of specificity, involved in matching a given feedstock, from which a given product is desired, with a suitable adsorbent/desorbent combination, under appropriate conditions to arrive at a commercially acceptable process.

FLECK et al., U.S. Pat. No. 2,881,862, discloses separating aromatic compounds and sulfur compounds from complex hydrocarbon streams through adsorption onto a "zeolitic metallo alumino silicate," which may be desorbed with linear pentane (see column 5, lines 49-54; column 6, lines 8-12).

KIMBERLIN et al., U.S. Pat. No. 2,950,336, discloses the separation of aromatic compounds and olefins from hydrocarbon mixtures that may also include paraffins, using a zeolitic molecular sieve which may be desorbed by gas purge, evacuation, displacement with an aromatic hydrocarbon, or steaming followed by dehydration (see column 4, lines 38–48).

TUTTLE et al., U.S. Pat. No. 2,978,407, discloses the separation of aromatic hydrocarbons from mixtures which include linear paraffins, isoparaffins, cyclic hydrocarbons, and aromatics, using molecular sieves having pore diameters of 13 Angstroms, which may be desorbed by gas purge and/or evacuation (see column 2, lines 65–70).

EPPERLY et al., U.S. Pat. No. 3,063,934, discloses removing aromatic compounds, olefins, and sulfur from the feed to a naphtha isomerization reactor using a molecular sieve, such as a Linde 10× or a Linde 13× molecular sieve, which may then be desorbed using the effluent from the isomerization reactor (see column 2, lines 36–41).

EPPERLY et al., U.S. Pat. Nos. 3,228,995 and 3,278,422 both generally disclose the separation of aromatics and/or nonhydrocarbons from saturated hydrocarbons and/or olefins using a zeolite adsorbent. The zeolite is desorbed with a polar or polarizeable substance, which is preferably ammonia, although sulfur dioxide, carbon dioxide, alcohols, glycols, halogenated compounds, and nitrated compounds may be used.

KONDO et al., U.S. Pat. No. 4,313,014, discloses the adsorptive separation of cyclohexene from a cyclohexene/cyclohexane mixture using a type X and/or type Y aluminosilicate zeolite, which may be desorbed with a trimethylbenzene (see column 2, lines 3–11).

OWAYSI et al., U.S. Pat. No. 4,567,315, discloses a process for removing aromatic hydrocarbons from a liquid paraffin. The aromatics are first adsorbed by a type X zeolite molecular sieve material, and are then desorbed using a polar or polarizeable substance such as an alcohol or glycol (see column 3, lines 65–68 and column 7, lines 15–20). In a third step the desorbed aromatic hydrocarbons are washed from the zeolite bed using a solvent such as n-hexane, n-heptane, or isooctane (see column 7, lines 26–30). MIWA et al., U.S. Pat. No. 4,571,441, discloses separating a substituted benzene from a substituted benzene isomer mixture using a faujasite-type zeolitic adsorbent such as type X zeolite or type Y zeolite. Depending on the nature of the substituted benzene whose recovery is desired, the desorbent used may be toluene, xylene, dichlorotoluene, chloroxylene, or trimethylbenzene; an oxygen-containing substance such as an alcohol or a ketone; or, diethylbenzene (see column 3, lines 35–59).

Russian Patent 1,298,202 discloses a method for removing aromatics from a paraffin feedstock using a solid adsorbent such as silica gel, amorphous aluminosilicate, or faujasite-type zeolite. A bed of the solid adsorbent is first pretreated with a stream of purified paraffins obtained from a prior purification cycle. The paraffin feedstock is then passed through the bed of solid adsorbent to remove aromatics therefrom until the aromatic content of the effluent reaches a specified level. Desorption of the adsorbed aromatics is carried out at 50°–500° C. using steam, ammonia, isopropyl alcohol, acetone, toluene, or the like. The desorbent must then be removed from the solid absorbent using a gas purge at 200°–500° C., and the bed must consequently be cooled to between 20°–150° C., using either a stream of purified paraffins or a gas, before resuming the adsorption phase.

Commonly owned, co-pending patent application U.S. Ser. No. 07/238,854 filed Aug. 31, 1988 entitled "Process for the Linear Paraffins" is directed to a to a process for purifying a hydrocarbon feedstock which contains linear paraffins, and at least one contaminant selected from the group consisting of aromatic compounds, nitrogen-containing compounds, sulfur-containing compounds, oxygen-containing compounds, color bodies, and mixtures thereof involves a) contacting a liquid feed stream of the hydrocarbon feedstock with an adsorbent comprising a zeolite having an average pore size of from about 6 to about 15 Angstroms under conditions suitable for the adsorption of the at least one contaminant by the zeolite to produce a contaminant-loaded zeolite; and b) desorbing the contaminant-loaded zeolite using a desorbent comprising an alkyl-substituted benzene. In this application, a feed forward control system is used to measure the aromatics and other impurities in the feed and to determine the adsorption cycle times based on a model or historical data which takes into consideration feed aromatics, adsorbent bed capacity, as well as other critical parameters. Feed forward control systems are conventional techniques whereby process control is accomplished by monitoring a variable to predict and control a subsequent related variable. In U.S. Ser. No. 07/238,854, Supercritical Fluid Chromatography (SFC), which involves the use of a supercritical fluid as a mobile phase with a porous silica stationary phase, is used to predict adsorbent bed utilization and to control the switching of adsorbent beds when the adsorbent in the adsorbent beds is predicted to be substantially saturated with aromatics and other impurities.

SUMMARY OF THE INVENTION

The present invention, however, is directed to a novel control process to improve the efficiency of conventional processes for purification of linear paraffins which involve adsorption using a feedback control system.

In accordance with the present invention, a feedback control technique has been discovered which can be employed to monitor the level of desorbent in the effluent of the adsorbing bed to determine when the adsorbent is saturated for the purpose of cycling the adsorbent beds, as required. A unique feature of the feedback control mechanism, technique or system of the present invention is that it can effectively accomplish the previously stated goal by monitoring only the level of the desorbent in the adsorber effluent, i.e., the adsorbent effluent stream, and no other effluent variables.

Accordingly, the feedback control mechanism of the present invention involves monitoring the level of the desorbent, which is preferably toluene, in the adsorbent effluent stream; comparing the level of desorbent in the adsorbent effluent stream to the desorbent level present in the feedstream introduced to the adsorbent bed; and switching the adsorbent beds at an appropriate time when the adsorbent within the bed is determined to be substantially saturated with impurities.

For purposes of the present invention, two adsorbent beds are employed in continuous, counter-current, liquid phase service. Although it has been discovered that the levels of desorbent in the effluent from the adsorber bed is impacted by the process temperature, space velocity and feed impurity levels, it has been discovered that feed impurity level, particularly aromatics, has a strong impact on desorbent levels in the adsorber effluent.

Specifically, the present invention is directed to the use of established on-line gas chromatography (GC) to monitor the desorbent in the adsorbent effluent stream, which is most preferably toluene, on a real time basis.

In accordance with the present invention, a feedback control procedure has also been developed which involves using on-line gas chromatography (GC) to monitor the desorbent levels in the adsorbent effluent stream on a real time basis, to supplement the previously mentioned feed forward strategy.

More specifically, the present invention is directed to a process for purifying a hydrocarbon feedstock which contains linear paraffins and at least one impurity selected from the group consisting of aromatic compounds, nitrogen-containing compounds, sulfur-containing compounds, oxygen-containing compounds, color bodies, and mixtures thereof, which involves the steps of contacting a liquid feedstream including such a hydrocarbon feedstock with an adsorbent containing desorbent in an adsorbent bed under conditions including temperature and space velocity and for a cycle time suitable for the adsorption of at least one impurity by the adsorbent to result in an adsorbent cycle effluent which includes purified hydrocarbon feedstock and an amount of the desorbent; monitoring the amount of desorbent in the adsorbent cycle effluent to determine a desorbent plateau level which corresponds to a level of the at least one impurity in the feedstream; and continuing to monitor until the amount of desorbent is detected as dropping below the desorbent plateau level thereby indicating that breakthrough of the impurity is occurring in the adsorbent cycle effluent and that the adsorbent is substantially saturated with the impurity to result in an impurity-loaded adsorbent. The impurity is an aromatic compound, which is present in the feed stream at a concentration of from about 0.1 to about 10.0 wt %; the aromatic compounds are preferably selected from the group consisting of alkyl-substituted benzenes, indanes, alkyl-substituted indanes, naphthalenes, tetralins, alkyl-substituted tetralins, biphenyls, acenaphthenes, and mixtures thereof. The process of the present invention also involves contacting the impurity-loaded adsorbent with desorbent at a weight hourly space velocity for the desorbent of from about 0.1 to about 2.5 WHSV, so as to result in a desorbed adsorbent containing desorbent. The desorbent is preferably an alkyl-substituted benzene, and most preferably toluene. The process of the present invention involves using a gas chromatography procedure to monitor the adsorbent cycle effluent, and also involves analyzing the liquid feedstream including the hydrocarbon feedstock using a supercritical fluid chromatography technique to predict the cycle time.

DETAILED DESCRIPTION OF THE INVENTION

Figure 1:
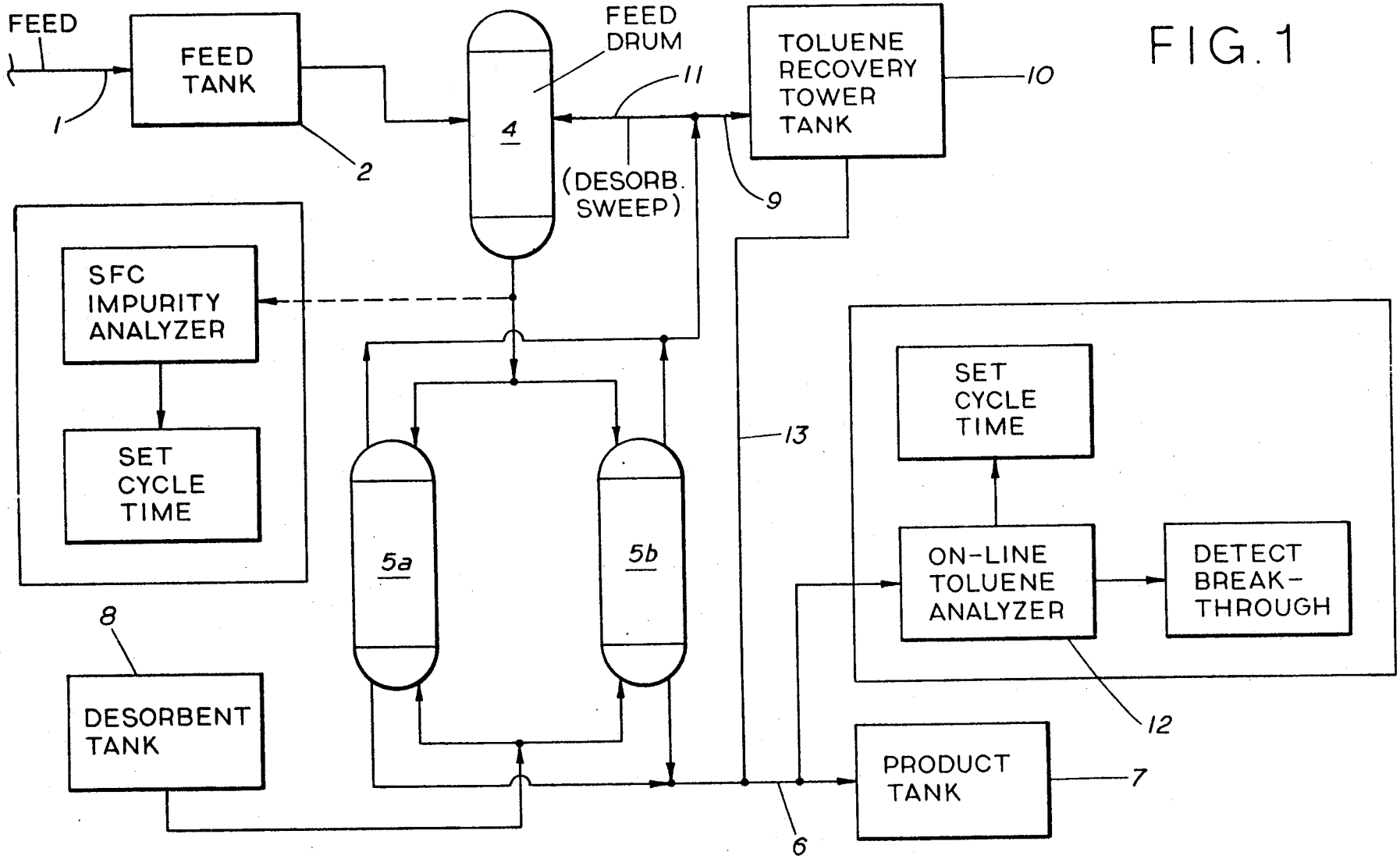
FIG. 1 is a flow chart for the control method for use in processes of purification of linear paraffins in accordance with the present invention.

The feedstock used to form the hydrocarbon stream to be purified according to the process of the present invention may be any hydrocarbon fraction which includes linear paraffins contaminated with aromatic and/or heteroatom compounds. Typically, the paraffins present in the feed stream have a carbon chain length of $C_8$–$C_{22}$.

One feedstock suitable for use in the process according to the present invention is the linear paraffin product from a process for separating linear paraffins from a kerosene-range hydrocarbon fraction. The linear paraffin effluent from such a process will typically consist principally of linear paraffins which, due to the nature of the crude stock from which they were isolated, will be contaminated with aromatics as well as with heteroatom compounds.

The aromatics may be present in the hydrocarbon stream in an amount of from about 0.1 to about 10.0 weight percent, and are typically present in an amount of from about 0.5 to about 3.0 percent.

Typical aromatic compounds present in the feedstock include monocyclic aromatics, such as alkyl-substituted benzenes, tetralins, alkyl-substituted tetralins, indanes, and alkyl-substituted indanes; indanes and naphthalenes; and bicyclic aromatics, such as naphthalenes, biphenyls, and acenaphthenes.

The feedstock may contain oxygen-containing compounds, i.e., hetero-atom-containing compounds. The most common oxygen-containing compounds found in the feedstock are phenolics, which may be present in the hydrocarbon feedstock at a concentration of up to about 600 wppm, and preferably up to about 300 ppm. Typically, phenolics are present in the feedstock at a concentration of between about 10 wppm and 150 wppm, and more typically within the range of about 10 wppm and about 100 wppm.

The amount of sulfur-containing compounds in the hydrocarbon feedstock may be as high as about 20 wppm. Typically the sulfur content is between about 1 and 15 wppm. Typical sulfur-containing compounds present in the feedstock include sulfides, thiophenes, and mercaptans, and mixtures thereof. Mercaptans may be present in amounts of up to about 1 wppm.

Nitrogen-containing compounds may be present in the hydrocarbon feedstock at a concentration of up to about 500 wppm. More typically, the concentration of nitrogen-containing compounds is between about 1.0 and 200 wppm. Typical nitrogen-containing compounds present in the feedstock include indoles, quinolines, and pyridines, and mixtures thereof.

In addition to the above contaminants, the feedstock to be purified according to the present invention may include color bodies. The Pt/Co color of the feedstock may be as high as about 30, measured by ASTM D-1209, and is typically between about 5 and 20.

In view of the foregoing, those of ordinary skill in the art should understand that feedstocks which may be treated by the process according to the present invention may contain diverse contaminants, composed principally of aromatics and oxygen-, sulfur-, and nitrogen-containing compounds as well as color bodies. Therefore, while representative categories of these contaminants are described above, the specific enumeration of these categories herein is illustrative only, and should not be considered as either limiting or exhaustive.

The hydrocarbon feed stream is preferably contacted in a liquid phase with a solid adsorbent. Before being contacted with the absorbent the feed is heated to a temperature of from about 20° to about 250° C.; the preferred temperature range for carrying out absorption is from about 100° to about 150° C. Back pressure regulation can be used to ensure maintenance of the liquid phase.

The flow rate of the hydrocarbon feed stream through the solid adsorbent is adjusted to range from about 0.2 WHSV to about 2.5 WHSV, with the preferred range being from about 0.75 WHSV to about 2.0 WHSV.

The desorbent is likewise contacted with the solid adsorbent in the liquid phase. The desorbent may also be heated to a temperature from about 20° C. to about 250° C. before being contacted with the adsorbent, with the preferred temperature range being substantially the same as the temperature at which the feed stream is contacted with the adsorbent.

The flow rate of the desorbent through the solid adsorbent may vary at least from about 0.1 WHSV to about 2.5 WHSV, preferably within the range of about 0.2 WHSV to about 2.5 WHSV and more preferably is from about 0.3 WHSV to about 1.5 WHSV.

The solid adsorbent used in the process according to the present invention may be any molecular sieve. It is preferred to use zeolites of the of the faujasite family, which includes natural and synthetic zeolites having an average having an average pore diameter of from about 6 to about 15 Angstroms. Representative examples of molecular sieves include faujasites, mordenites, and zeolite types X, Y, and A. The zeolites most preferred for use in the process according to the present invention are zeolite types X and Y.

The zeolite more preferably has a pore size of between about 6.8 and about 9 Angstroms, and may be substantially in the form of crushed or beaded particles.

In one particular embodiment, the zeolite may be a type Y zeolite, and more specifically may be a cation-exchanged type Y zeolite. The cations may be selected from the group consisting of alkali and alkaline earth metals.

In a particularly preferred embodiment, the cation-exchanged type Y zeolite is MgY zeolite.

The zeolite may alternatively be a type X zeolite, such as NaX zeolite.

The adsorbent used in the process according to the present invention may include an inorganic binder such as silica, alumina, silica-alumina, kaolin, or attapulgite.

The zeolites may be subjected to cation exchange prior to use. Cations which may be incorporated into the zeolites, through ion-exchange processes or otherwise, include all alkali and alkaline earth metals, as well as trivalent cations, with Na, Li, and Mg being preferred.

The most preferred zeolites for use in the process according to the present invention are NaX zeolite, commonly referred to as 13× zeolite, and MgY zeolite.

While the zeolite may be used in any form, it is preferred to use zeolite in the form of beaded or crushed particles, rather than extruded particles. The zeolite may be used neat, or in association with known binders including, but not limited to, silica, alumina, aluminosilicates, or clays such as kaolin and attapulgite.

In a preferred embodiment of the process according to the present invention the adsorption and desorption cycles or phases are conducted counter-current to each other. Specifically, adsorption is effected by contacting the hydrocarbon feedstock with the bed of solid adsorbent in downflow fashion which has been discovered to be advantageous because downflow adsorption eliminates density gradient backmixing, which interferes with the adsorption process and thus impairs product quality; and conducting desorption in an upflow direction using a lower mass velocity reduces concerns over lifting of the beds of solid adsorbent, which can otherwise occur during desorption.

In preferred embodiments the process according to the present invention utilizes a desorbent which is of the same class of molecules of the predominant impurity being removed by the adsorption process. Preferably the desorbent is a nonpolar, alkyl-substituted benzene to desorb aromatic contaminants from the saturated adsorbent. Under the operating conditions which have been found most suitable for carrying out the process according to the present invention, most preferred desorbent is toluene.

Thus, the process according to the present invention enables use of an aromatic desorbent, such as an alkyl-substituted benzene, e.g. toluene, which is efficient, readily available, inexpensive, easily displaced from the solid adsorbent during the subsequent adsorption step, and simply separated from the product.

While the aromatic desorbent may be used in a mixture with other hydrocarbons having similar boiling points (e.g., heptane may be used with toluene), it is preferred to formulate the desorbent principally from the aromatic substituent, with toluene being the preferred aromatic. Thus, while the desorbent may include non-toluene hydrocarbons in an amount of up to about 90%, the preferred desorbent contains non-toluene hydrocarbons in an amount of between about 0.0001 and 10%. In a particularly preferred embodiment the desorbent comprises at least about 95 percent by weight toluene, with the balance of the desorbent being made up of non-toluene hydrocarbons.

The desorbent may also include dissolved moisture in relative trace amounts. Generally, dissolved water may be present in the desorbent in an amount of up to about 500 wppm, with a range of from about 50 to about 300 wppm being preferred.

In the preferred embodiment in accordance with the present invention, it is preferred to use two adsorbent beds in the continuous, counter current, liquid phase adsorption process. Although not wishing to be bound by any particular theory, it is believed that the lack of a purge or an intermediate cleaning step is at least part of the reason that there are levels of the desorbent in the adsorber effluent. Also, it is believed that because the desorbent displaces the contaminants by taking their place in the pores of the solid adsorbent, when the regenerated adsorbent bed is placed back on line and is again contacted with the hydrocarbon feedstock, the initial effluent issuing from the adsorbent bed will contain some of the desorbent. This may be separated from the purified linear paraffin product by any conventional means, such as by distillation. The desorbent thus separated may, if desired, be recycled to the desorption stage; water may be added to or removed from the separated desorbent to achieve the desired composition for the desorbent prior to recycle.

In this regard, in accordance with the present invention, it has been discovered that the level of desorbent in the effluent from the adsorber bed is impacted by the process temperature, space velocity, and feed impurity levels. Although not wishing to be bound by any particular theory, it is believed that the feed impurity level has a particularly strong impact on the level of desorbent in the adsorber effluent because it has been discovered that the level of feed aromatic impurities in the adsorber feed strongly correlates with the level of desorbent in the adsorb effluent.

The desorbent is preferably separated from the at least one contaminant after the desorbing step, and the desorbent is recycled to the desorbing step. The desorbent may be separated from the at least one contaminant by any conventional means, such as by distillation.

Alternatively, effluent from the adsorption and desorption cycles may be recycled to the feedstream as disclosed in commonly owned co-pending patent application Ser. No. 07/601,345 filed on even date herewith, i.e. Oct. 23, 1990, in the names of the inventors of the present application entitled "IMPROVED RECYCLE FOR PROCESS FOR PURIFICATION OF LINEAR PARAFFINS", the disclosure of which is hereby incorporated in its entirety herein by reference thereto.

In the linear paraffin purification process according to the present invention the adsorption and desorption steps are conducted entirely in the liquid phase, at substantially constant temperatures; this eliminates the time and expense, including increased equipment stress, involved in changing over between liquid and vapor phases as in the prior art. Also, the process according to the present invention uses a nonpolar desorbent which is widely available, inexpensive, and easy both to displace from the solid adsorbent and to separate from the product; use of a nonpolar desorbent additionally eliminates the need to wash, purge, or otherwise treat the solid adsorbent bed after the desorption step but before again contacting the solid adsorbent bed with the hydrocarbon feed stream. In addition, the adsorption and desorption steps are conducted countercurrent; use of the countercurrent technique results in a more efficient use of the desorbent, and consequently also leads to improved adsorption. Also, the adsorption step is conducted in a downflow fashion which eliminates the detrimental density gradient-related backmixing which can occur during upflow adsorption as the relatively dense toluene is displaced from the solid absorbent by the relatively light paraffin feed stream. Moreover, by using a lower mass velocity while conducting desorption countercurrently in an upflow fashion, bed lifting concerns can be substantially reduced. The use of a switchable recycle technique for the recovery and recycle of both hydrocarbon feed and desorbent has been discovered to enhance the efficiency in economy of the process according to the present invention. A nitrogen blanket is used to conduct the entire process under oxygen-free conditions which avoids introduction of oxygen into the hydrocarbon and desorbent streams, which could otherwise lead to oxidative degradation of the feed hydrocarbon components and consequent formation of undesirable side products.

For purposes of the present invention, the process according to the present invention uses a feedback control strategy via monitoring the level of desorbent in the effluent of the adsorbing bed instead of, or in addition to, an analytical feed forward technique to monitor the composition of the hydrocarbon feed stream, e.g., the Supercritical Fluid Chromatography (SFC) used in parent application U.S. Ser. No. 07/238,854, to provide a method for determining the proper cycle time between adsorption and desorption.

A feed forward model which is used for this purpose can be defined by the following equation:

$$\text{cycle time (hrs)} = \frac{\text{conversion factor} \times \text{sieve capacity (lbs./lb.)} \times \text{quantity of sieve material in the adsorber (lbs.)}}{\text{aromatics level (\%)} \times \text{feed density (lbs./ft.}^3\text{)} \times \text{feed rate (barrels/day)}}$$

A typical cycle time is determined as follows:

$$5.3 \text{ hrs.} = \frac{427 \times 0.12 \text{ lbs./lb.} \times 55{,}500 \text{ lbs.}}{1.85\% \times 47.1 \text{ lb./ft.}^3 \times 6{,}200 \text{ B/day}}$$

wherein the aromatics level of the feedstream is analyzed using SFC.

The process according to the present invention makes it possible to recover at least about 95 percent of the linear paraffins present in the initial hydrocarbon charge introduced into the solid adsorbent bed in a single adsorb/desorb cycle, without heating, cooling, washing, purging, or changing between vapor and liquid phases. This measurement of efficiency is referred to hereinafter as "once-through paraffin recovery."

The process according to the present invention may be more fully appreciated through an understanding of how it fits into an overall hydrocarbon processing and refining operation:

In an initial step, a full-range kerosene hydrocarbon feed stream is processed through a linear paraffins separation process. This feed stream typically contains only a minor proportion of linear paraffins, e.g., 8–30%, with the balance of the stream being made up of iso- and cycloparaffins, aromatics, and heteroatom-containing compounds.

The partially purified linear paraffin product, which is contaminated by aromatic compounds and by heteroatom-containing compounds then becomes the feedstream for the process according to the present invention. Although not necessary in view of the feedback monitoring of the adsorption effluent stream in accordance with the present invention, the concentration of aromatics in the feedstream, which affects adsorption cycle length, optionally can also be measured using the Supercritical Fluid Chromatography (SFC) process referred to earlier. As a preferred embodiment, a combination of a feed forward and a feed back control can be used.

The process according to the present invention utilizes two fixed beds of solid adsorbent being operated in cyclic fashion, so that one bed is undergoing adsorption while the other bed is being desorbed. Before the process is initiated the beds are preferably blanketed with nitrogen to create an oxygen-free environment. This prevents oxygen from being introduced into the hydrocarbon stream; otherwise, oxidative degradation of the feed hydrocarbon components could occur, resulting in formation of undesirable side products. When the bed undergoing adsorption reaches the end of its cycle, as measured by a threshold value for aromatics concentration in the adsorption effluent, the beds are switched. The switching may be accomplished using a programmable controller and remote-operated valves. A typical adsorption cycle will last from about 4 hours to about 17 hours, but can vary considerably depending on variables such as feed rate, the concentration of aromatics in the feed, the age of the solid adsorbent, and the amount of absorbent used.

It is at this stage of the process where the inventive feedback control system of the present invention is employed. The feedback control system of the present invention utilizes a mechanism or technique which involves monitoring the level of the desorbent in the effluent from the adsorbing beds.

Referring now to FIG. 1, a hydrocarbon feedstock to be purified 1 is introduced into feed tank 2. From the feed tank 2, the feedstream of the liquid hydrocarbon feedstock, which contains at least one impurity selected from the group consisting of aromatic compounds nitrogen-containing compounds, sulfur-containing compounds, oxygen-containing compounds, color bodies, and mixtures thereof, is fed into a feed drum 4 prior to being introduced into one of the two adsorbent beds 5*a* and 5*b*. Typically, the feedstock contains 98.0% $C_{10}$–$C_{19}$ linear paraffins in addition to about 2.0% of kerosene boiling range aromatics. The adsorbent beds 5*a* and 5*b* contain 13 type X zeolite molecular sieve that has been desorbed by passing toluene over the sieve. Thus, an amount of interstitial toluene would remain in the adsorbent bed when the previously identified feedstock is introduced. Thus, at the beginning of the adsorption cycle, the previously identified paraffin feed enters the adsorbent bed and volumetrically displaces interstitial toluene; and the adsorbent cycle effluent contains the previously identified linear paraffin material from which impurities have been removed by the adsorbent bed in addition to displaced interstitial toluene. The adsorbent cycle effluent 6 is then passed to the product tank 7. Recycle stream 13 is the initial adsorber effluent that contains the bulk of the interstitial toluene and can be recycled to the desorbent recovery tower feedtank. Note that the present invention is also useful in monitoring the optimal switch time between recycle stream 6 and recycle stream 13. When the adsorbent beds 5*a* and 5*b* have become saturated with impurities, the desorption cycle is initiated; in so doing, desorbent, such as toluene, is introduced in a counter-current manner through adsorbent bed 5*a* or 5*b*, as is appropriate. The desorbent initially displaces the impurities from the adsorbent by taking their place in the pores of the solid adsorbent with the displaced impurities in the admixture with desorbent 9 being passed to impurity tank 10. Prior to the impurities being displaced from the adsorbent bed, the desorbent to displaces interstitial hydrocarbon feedstock molecules and the resultant mixture of linear paraffins and toluene 11 is recycled to feed drum 4.

The feedback control mechanism of the present invention involves monitoring the level of desorbent, i.e., toluene, in the adsorbent effluent stream 6, and then comparing this level to the toluene level present in the feedstream being supplied to the adsorbent beds 5*a* and 5*b*, and switching the operation of these adsorbent beds at appropriate intervals, when it is determined that the adsorbent material contained within the bed operating in the adsorbent cycle is substantially saturated with impurities.

Figure 2:
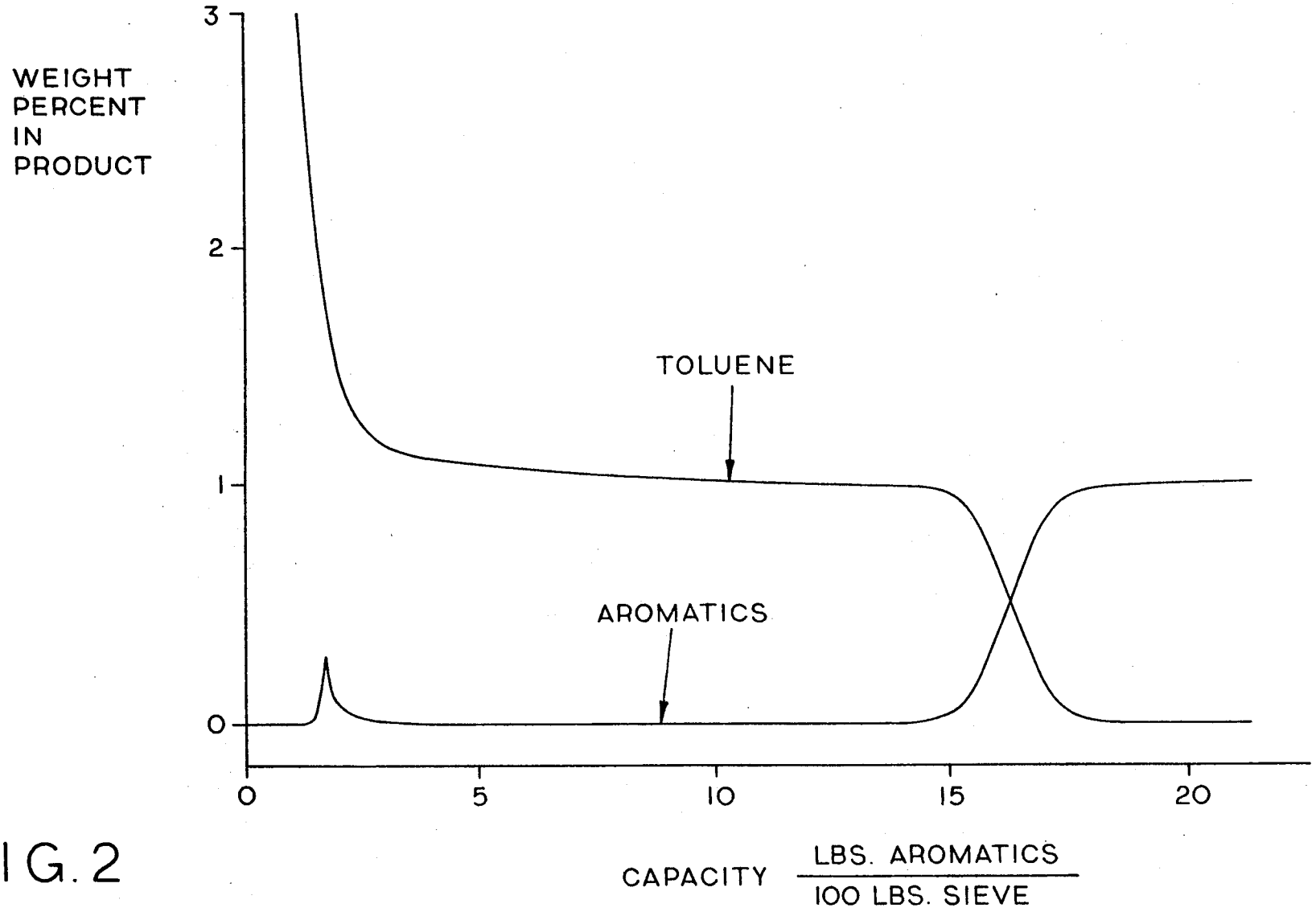
FIG. 2 is a graph depicting the results of monitoring the feed impurity level and the level of desorbent in the adsorber effluent.

As illustrated in FIG. 2, toluene levels in the adsorbent effluent are considered to plateau at a level which equals the total aromatics level, i.e., aromatic impurities plus toluene desorbent, in the feedstream to the adsorbent bed 5*a* or 5*b* as long as the adsorbent material within the adsorbent beds 5*a* or 5*b* retains its capacity for adsorbing additional impurities. As the impurity level in the adsorbent effluent begins to rise, thereby indicating that the adsorbent is becoming saturated, the toluene levels begin to decrease.

In order to track toluene, or similar desorbent material, an on-line toluene analyzer, i.e., gas chromatography (GC), 12 is operably connected with the adsorbent effluent stream 6 line. The on-line gas chromatograph (GC), which is otherwise a conventional piece of analytic equipment, measures the plateau level of toluene in the adsorbent effluent stream in real time. Once the plateau level of toluene is determined, decreases in the toluene level below the plateau level can be detected via the on-line GC. As the toluene level drops below the plateau level, this indicates that the adsorbent is becoming saturated. This phenomena is demonstrated by the graph of experimental data attached hereto as FIG. 2. When the toluene substantially disappears, the adsorbent is completely saturated. Inasmuch as it is desired to cycle or switch the adsorbent beds 5*a* and 5*b* when the average effluent from an adsorbent bed is less than about 100 ppm, the on-line GC is used as a feedback control technique, alone or in conjunction with the SFC feed-forward technique, to maintain the average adsorbent effluent impurity levels at a target value.

Thus, the feedback monitoring system used in accordance with the present invention has been discovered to be an effective way for detecting changes in the aromatic impurity concentration at the level of the aromatic impurities in a background of desorbent and linear paraffins and has been discovered to be particularly suitable for the continuous process for the purification of linear paraffins in that the desorbent level in the adsorbent effluent is monitored and used to determine when the adsorbent material in the adsorbent beds 5*a* or 5*b* is saturated to permit switching or cycling the beds from an adsorbent cycle to a desorbent cycle, as required. In accordance with the present invention, the feedback control system of the present invention monitors the level of the desorbents which appears in the adsorbent effluent, and no other effluent variables, to accomplish this goal. Alternatively, or in addition a slipstream could be collected from beds 5*a* or 5*b* and analyzed, if desired.

As previously mentioned, it is believed that the lack of a purge or an intermediate cleaning step is at least part of the reason why there are levels of desorbent in the adsorber effluent.

The purified linear paraffin effluent from the adsorption step is sent on to a fractionation column, where light paraffins and residual toluene are removed.

During fractionation the residual desorbent present in the purified paraffin effluent is removed as a liquid distillate. A mixture of light paraffins and toluene is taken off the column as a liquid sidestream, while the heavier paraffin bottoms product is sent on for separation into final products.

The toluene effluent from the desorption step is sent to a toluene recovery tower. Overhead toluene product from this tower then may be heated and recycled to the solid adsorbent beds for use in the desorption step. The tower bottoms product may be cooled, and recycled to a linear paraffins separation process.

Prior to entering the recovery tower the contaminated toluene may be sent to a storage tank, which can also receive recycled toluene from the fractionation column overhead, and makeup toluene may be used to replace the toluene which escapes recovery and recycle. This storage tank can be used to mix the various streams sent into it in order to provide an output stream of consistent composition.

In summary, then, the toluene used for desorption of the solid adsorbent beds is recycled. However, because light paraffins in the $C_6$–$C_8$ range are very difficult to separate from toluene by fractionation, these paraffins will tend to build up in the recycled desorbent. This build-up can be controlled by removing a purged stream from the desorbent recycle, thereby limiting the presence of light hydrocarbon component impurities in the desorbent to about 5%.

Because the bed of solid adsorbent is full of feed stream at the end of an adsorption step, the initial effluent from the subsequent desorption step will consist largely of residual paraffins. A particularly valuable feature of the process according to the present invention is recovery of these paraffins by providing for a recycle of the initial desorbent effluent back to the feed for the present process. When desorbent begins to appear in the effluent, the effluent can then be sent to the toluene recovery tower. By this procedure many of the paraffins that would otherwise be rejected as toluene recovery tower bottoms can be recovered, resulting in an improved once- through paraffin recovery.

The initial desorb cycle effluent that is recycled may include toluene in trace quantities, resulting in a concentration of toluene in the feed stream of up to about 5.0%, with a concentration range of from less than about 0.1 to about 0.5% being preferred. At these levels the toluene behaves simply as another aromatic contaminant in the feed stream.

Similarly, because the bed of solid adsorbent is substantially full of toluene at the end of a desorption step, the initial effluent from the subsequent adsorb cycle will consist largely of residual toluene. Therefore, in the process according to the present invention this initial adsorption effluent is routed to the toluene recovery tower, enabling the toluene therein to be recovered and recycled. When the paraffin content of the adsorption effluent begins to rise the effluent stream is routed to the holding tank, and from there is sent to the fractionation column. This has the particularly valuable effect of reducing the fractionation load to this tower.

By means of this process a linear paraffin product may be obtained in which the concentration of aromatic compounds has been reduced from a feedstock content of as high as about 10 percent to a product content of less than about 100 wppm, and even of less than about 50 wppm.

The present invention extends to the purified linear paraffin product produced according to the process according to the present invention. This purified linear paraffin product may have a purity of at least about 98.5 wt %, and may contain not greater than about 80 wppm aromatics, not greater than about 1 wppm nitrogen-containing compounds, not greater than about 0.1 wppm sulfur-containing compounds, and not greater than about 10 wppm oxygen-containing compounds. The amount of aromatic compounds present in the purified linear paraffin product may be not greater than about 10 wppm aromatics, and the purity of the purified linear paraffin product may be least about 99.7 wt %.

The amount of aromatics present in the purified linear paraffin product may be not greater than about 10 wppm aromatics.

Finally, the present invention results in a purified linear paraffin having a purity of at least about 98.5 wt %, which may contain not greater than about 80 wppm aromatics, not greater than about 1 wppm nitrogen-containing compounds, not greater than about 0.1 wppm sulfur-containing compounds, and not greater than about 10 wppm oxygen-containing compounds. The amount of aromatic compounds present in the purified linear paraffin may be not greater than about 10 wppm aromatics, and the purity of the purified linear paraffin may be least about 99.7 wt %. The amount of aromatics present in the purified linear paraffin may be not greater than about 10 wppm aromatics. Comparable degrees of purification may be obtained with respect to sulfur- and nitrogen-containing contaminants. Whereas the hydrocarbon feedstock may include up to about 20 wppm of sulfur and up to about 300 wppm of nitrogen- containing hydrocarbons, the purified product will contain less than 0.1 wppm of sulfur-containing compounds; less than 1 wppm of nitrogen-containing compounds; and, less than about 10 wppm of phenolics.

The advantages which can be realized through the practice of the process according to the present invention are perhaps most simply stated, and most dramatically evident, in the fact that 95% of the linear paraffins present in the initial feedstock charged to the solid adsorbent bed are recovered in a single adsorb/desorb cycle. This recovery is accomplished without resort to washing, purging, heating, cooling, liquid/vapor phase changes, or other complications.

The process according to the present invention may be further appreciated by reference to the following example and table, which are of course only representative of the present invention and in no way limiting.

EXAMPLE

Referring again to FIG. 1 for the general flow chart of the process in accordance with the present invention, a feed containing 99.0% $C_{12}$–$C_{16}$ linear paraffins including 1.0% of m-diisopropyl benzene is contacted at 250° F. and at an hourly space velocity of 0.1 with an adsorbent bed which is 96 inches in length, 2.6 inches in diameter and contains 11.0 pounds of 13 type X zeolite molecular sieve that has been desorbed by passing toluene over the adsorbent sieve material. Interstitial toluene is left in the adsorbent bed. As the feed is introduced into the adsorbent bed, at the beginning of the adsorbent cycle, the paraffin feed entering the bed volumetrically displaces the interstitial toluene. As the interstitial toluene is displaced, the toluene concentration measured in the adsorbent effluent begins to increase. The toluene level then decreases to a plateau level, which is primarily impacted by the level of aromatic impurities in the feed. In this example, the toluene plateau level is 1.0% and is the equivalent to the aromatics level in the hydrocarbon feedstream being introduced to the adsorbent bed. As long as the toluene remains at the plateau level, this is indicative that the adsorbent material in the adsorbent bed is still removing the aromatic impurity from the feedstock. However, when the toluene level begins to drop below the plateau level, this indicates that some feed aromatics are not being adsorbed on to the adsorbent, thus not liberating toluene desorbent in the process, and that the time is approaching for switching or cycling the adsorbent bed to the desorption cycle.

As can be seen from the graph in FIG. 2, the desorbent level in the adsorber effluent declines quickly from approximately 100% to a plateau level that correlates with the level of aromatic impurities in the feed. As the desorbent level drops below this plateau, aromatic break through is occurring in the adsorber effluent which is an indication of the need to switch the adsorbing beds to desorption service.

It will be appreciated to those of ordinary skill in the art that, while the present invention has been described herein by reference to particular means, methods, and materials, the scope of the present invention is not limited thereby, and extends to any and all other means, methods, and materials suitable for practice of the present invention.

WHAT WE CLAIM IS:

1. A process for purifying a hydrocarbon feedstock which contains linear paraffins and at least one impurity selected from the group consisting of aromatic compounds, nitrogen-containing compounds, sulfur-containing compounds, oxygen-containing compounds, color bodies, and mixtures thereof, said process comprising the steps of:

a) contacting a liquid feedstream comprising said hydrocarbon feedstock with an adsorbent containing desorbent in an adsorbent bed under conditions comprising temperature and space velocity and for a cycle time suitable for the adsorption of said at least one impurity by said adsorbent to result in an adsorbent cycle effluent comprising purified hydrocarbon feedstock and an amount of said desorbent;

b) monitoring said amount of desorbent in said adsorbent cycle effluent to determine a desorbent plateau level which corresponds to a level of said at least one impurity in said feedstream; and c) continuing said monitoring of step b) until said amount of desorbent is detected as dropping below said desorbent plateau level thereby indicating that breakthrough of said at least one impurity is occurring in said adsorbent cycle effluent and that said adsorbent is substantially saturated with said at least one impurity to result in an impurity-loaded adsorbent.

2. The process as defined by claim 1, wherein said at least one impurity comprises aromatic compounds.

3. The process as defined by claim 2, wherein said aromatic compounds are present in said feed stream at a concentration of from about 0.1 to about 10.0 wt %.

4. The process as defined by claim 3, wherein said aromatic compounds are selected from the group consisting of alkyl-substituted benzenes, indanes, alkyl-substituted indanes, naphthalenes, tetralins, alkyl-substituted tetralins, biphenyls, acenaphthenes, and mixtures thereof

5. The process as defined by claim 2, wherein said contacting of step a) is at an operating temperature of from about 20° C. to about 250° C.

6. The process as defined by claim 2, wherein said contacting of step a) is at a weight hourly space velocity of from about 0.1 to about 2.5 WHSV.

7. The process as defined by claim 2, further comprising d) contacting said impurity-loaded adsorbent with desorbent at a weight hourly space velocity for said desorbent of from about 0.1 to about 2.5 WHSV, so as to result in a desorbed adsorbent containing desorbent.

8. The process as defined by claim 7, wherein said desorbent is an alkyl-substituted benzene.

9. The process as defined by claim 8, wherein said desorbent comprises toluene.

10. The process as defined by claim 9, wherein said desorbent comprises at least about 95% toluene.

11. The process as defined by claim 8, wherein said adsorbent is a zeolite having a pore size is between about 6 and about 15 Angstroms.

12. The process as defined by claim 11, wherein said monitoring of step b) comprises analyzing said adsorbent cycle effluent using a gas chromatography procedure.

13. The process as defined by claim 12, further comprising analyzing said liquid feedstream comprising said hydrocarbon feedstock using a supercritical fluid chromatography technique to determine said cycle time for automatically controlling said contacting of step a).

* * * * *